US007290514B2

(12) United States Patent
Hoi

(10) Patent No.: US 7,290,514 B2
(45) Date of Patent: Nov. 6, 2007

(54) VALVE TRAIN LUBRICATING STRUCTURE IN INTERNAL COMBUSTION ENGINE

(75) Inventor: Yosuke Hoi, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/069,542

(22) Filed: Mar. 2, 2005

(65) Prior Publication Data

US 2005/0199202 A1 Sep. 15, 2005

(30) Foreign Application Priority Data

Mar. 10, 2004 (JP) ..... 2004-068158

(51) Int. Cl.
*F01M 1/06* (2006.01)

(52) U.S. Cl. ..... 123/90.33; 123/90.34; 123/90.38; 123/196 R; 123/196 AB; 184/6.5; 184/6.9; 440/88 L

(58) Field of Classification Search ..... 123/90.33, 123/90.34
See application file for complete search history.

(56) References Cited

U.S. PATENT DOCUMENTS 4,793,301 A * 12/1988 Ishikawa ..... 123/196 R
4,957,079 A * 9/1990 Nakatani et al. ..... 123/90.34
5,037,340 A * 8/1991 Shibata ..... 440/88 L
6,161,515 A * 12/2000 Kopec ..... 123/196 R
6,314,934 B1 * 11/2001 Ito et al. ..... 123/196 R
6,638,123 B2 * 10/2003 Kinomoto ..... 440/88 L
2004/0255894 A1 * 12/2004 Barber et al. ..... 123/196 R

FOREIGN PATENT DOCUMENTS

JP 6-18007 Y2 5/1994

* cited by examiner

*Primary Examiner*—Thomas Denion
*Assistant Examiner*—Kyle M. Riddle
(74) *Attorney, Agent, or Firm*—Birch, Stewart, Kolasch & Birch, LLP

(57) ABSTRACT

To prevent a drop in a lubricating oil supply pressure in a valve train from occurring by disposing a lubricating oil supply path for the exclusive use of the valve train without allowing the lubricating oil to flow through an oil gallery, thereby securing a sufficient amount of supply of the lubricating oil in the valve train to enhance lubrication efficiency. A feed pump rotating with a crankshaft is disposed at a leftward end of the crankshaft. Lubricating oil supplied from the feed pump flows through an oil cooler and an oil filter. Part of the lubricating oil is supplied through a lubricating oil supply path to an oil gallery and to journals, crankpins, and the like of the crankshaft. The other part of the lubricating oil is supplied through lubricating oil supply paths for the exclusive use of the valve train.

22 Claims, 13 Drawing Sheets

VALVE TRAIN LUBRICATING STRUCTURE IN INTERNAL COMBUSTION ENGINE

CROSS-REFERENCE TO RELATED APPLICATIONS

The present application claims priority under 35 USC 119 to Japanese Patent Application No. 2004-068158 filed on Mar. 10, 2004 the entire contents of which are hereby incorporated by reference.

BACKGROUND OF THE INVENTION

1. Field of the Invention

The present invention relates generally to a structure of an internal combustion engine. More particularly, to a lubricating structure for a valve train including a camshaft or the like in an internal combustion engine.

2. Description of Background Art

One of the most commonly used conventional lubricating structures for a valve train such as a camshaft or the like in an internal combustion engine is constructed as follows. More specifically, lubricating oil pumped up from an oil strainer by an oil pump flows past an oil filter as the oil is fed from the oil pump through a lubricating oil inflow path. The lubricating oil is thereby fed to an oil gallery. The lubricating oil is then supplied through a lubricating oil supply path branching off the oil gallery. This lubricating oil supply path constitutes one of a greater system of lubricating oil supply path for supplying the lubricating oil to different parts of the internal combustion engine through the oil gallery. There is known another structure, in which the lubricating oil having flowed past the oil filter does not flow through the oil gallery. More specifically, the lubricating oil having flowed past the oil filter is directly supplied to the valve train including the camshaft or the like through a lubricating oil supply path branching off a point near a lubricating oil outlet of the oil filter. See, for example, Japanese Utility Model Publication No. Hei 6-18007, Pages 2 to 3 and FIG. 4.

The invention disclosed in Japanese Utility Model Publication No. Hei 6-18007, as shown in FIG. 13 of the drawings, relates to a lubricating structure in an internal combustion engine 0E. This lubricating structure includes an oil pump 0Pf disposed on a shaft end of a crankshaft 01 of the internal combustion engine 0E. The lubricating structure works as follows. More specifically, rotation of the oil pump 0Pf as a result of rotation of the crankshaft 01 draws the lubricating oil from the oil strainer. The lubricating oil, the pressure of which has been boosted in the oil pump 0Pf, is sent through a lubricating oil supply path 0F1 to an oil filter 012.

The lubricating oil fed to the oil filter 012 flows through, and is filtered by, the oil filter 012. There are provided lubricating oil supply paths 0F2 and 0F3 branching off a point near a lubricating oil outlet of the oil filter 012. The lubricating oil supply path 0F2, of these two lubricating oil supply paths 0F2 and 0F3, is oriented horizontally. Part of the aforementioned lubricating oil is supplied through this horizontally oriented lubricating oil supply path 0F2 to an oil gallery 0F4. The lubricating oil supply path 0F2 is disposed to extend to a position near a water jacket of a cylinder block. Accordingly, the lubricating oil that has been preferably cooled is supplied to the oil gallery 0F4 through the lubricating oil supply path 0F2.

The lubricating oil fed to the oil gallery 0F4 is further supplied from the oil gallery 0F4 to a bearing portion and the like of the crankshaft 01 via a plurality of branch supply paths 0F5. In addition, another part of the lubricating oil is directly supplied to the valve train such as the camshaft and the like through the lubricating oil supply path 0F3 that is not connected to the oil gallery 0F4 and is oriented substantially vertically.

Conventionally, the supply of the lubricating oil to the valve train in the internal combustion engine is commonly accomplished through the supply path branching off the oil gallery as described above. However, in the type of lubricating oil supply structure for the valve train such as that described above, the valve train is disposed at a level relatively higher than other lubricating oil supply portions. Moreover, the distance between the valve train and the oil gallery is greater than the distance between each of the other lubricating oil supply portions and the oil gallery. As a result, a phenomenon occurs wherein the pressure of the supplied oil drops during a low speed operation of the engine or the like. When this phenomenon occurs, a sufficient amount of lubricating oil is not secured for the valve train. Therefore, there is a need for positive and effective lubrication in the valve train.

The lubricating structure in the internal combustion engine as disclosed in Japanese Utility Model Publication No. Hei 6-18007 has at least one advantage. More specifically, the structure allows the lubricating oil that has flowed through the oil filter to be supplied directly to the valve train via a supply path branching off a point near the outlet of the lubricating oil of the oil filter. This supply path is not routed through the oil gallery. The structure therefore has an advantage in that the aforementioned phenomenon of the pressure drop of the supplied oil supplied to the valve train can be prevented.

The lubricating structure of the invention as disclosed in Japanese Utility Model Publication No. Hei 6-18007 does not, however, ensure a sufficient amount of supply of the lubricating oil in the valve train. Therefore, there is a need for a concrete structural feature for securing a positive amount of supply of the lubricating oil. Moreover, the object of the invention disclosed in Japanese Utility Model Publication No. Hei 6-18007 is to promote preferable cooling of the lubricating oil by disposing the lubricating oil supply path in an extended position near the water jacket. That is, the invention does not originally have a clear object of securing a sufficient amount of the lubricating oil to be supplied to the valve train. Further, no consideration is given to a structural feature of the lubricating structure in terms of securing a sufficient amount of the lubricating oil to be supplied to the valve train by preventing a drop in the supply pressure of the lubricating oil to the valve train. Therefore, there is room for structural improvements to be made on the lubricating structure of the invention from the viewpoint of securing a sufficient amount of supply of the lubricating oil by preventing a pressure drop in the supply of the lubricating oil to the valve train.

SUMMARY AND OBJECTS OF THE INVENTION

Under these circumstances, there is a need for the improved lubricating structure incorporating the following specific viewpoints. More specifically, the improved lubricating structure prevents a drop in pressure of the supply oil in the supply of the lubricating oil to the valve train including the camshaft or the like. The improved structure ensures a sufficient amount of supply of the lubricating oil to the valve train including the camshaft or the like particularly when the internal combustion engine runs at low speed. The improved structure achieves positive and effective lubrication in the valve train. Further, the improved structure is intended for simple and low-cost lubrication. The improved structure particularly represents a viewpoint of an improved disposition of the supply path of the lubricating oil.

To solve the aforementioned problems of the prior art, according to the present invention, there is provided a lubricating structure for a valve train including a camshaft or the like in an internal combustion engine. More particularly, the present invention relates to an improvement made on the lubricating structure for achieving an assurance of a sufficient amount of supply of a lubricating oil for the camshaft or the like even during a low speed rotation of the internal combustion engine. The valve train lubricating structure in the internal combustion engine includes an oil pump, a supply path, and a plurality of branch supply paths. The oil pump is rotated by being operatively connected with the rotation of a crankshaft. The supply path provides a route, through which the lubricating oil delivered from the oil pump is supplied to an oil gallery. The plurality of branch supply paths provides routes, through which the lubricating oil is supplied to different parts of the internal combustion engine. One of the plurality of branch supply paths forms a supply path of the lubricating oil to the valve train. The valve train lubricating structure in the internal combustion engine includes the following point. More specifically, the supply path of the lubricating oil to the valve train includes a check valve and the supply path going to the oil gallery is branched off at a point upstream of the check valve.

According to the present invention, the valve train lubricating structure in the internal combustion engine includes an oil pump, a supply path, and a plurality of branch supply paths. The oil pump is rotated by being operatively connected with the rotation of a crankshaft. The supply path provides a route, through which the lubricating oil delivered from the oil pump is supplied to an oil gallery. The plurality of branch supply paths provides routes, through which the lubricating oil is supplied to different parts of the internal combustion engine. One of the plurality of branch supply paths forms a supply path for the lubricating oil to the valve train. The supply path for the lubricating oil to the valve train includes a check valve and the supply path going to the oil gallery is branched off at a point upstream of the check valve. Because of this arrangement, a drop in the supply pressure can be suppressed and a sufficient amount of supply of the lubricating oil to the valve train can be ensured. Further, positive and effective lubrication of the camshaft and the valve train including the camshaft can be achieved.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The present invention is embodied by providing a lubricating oil supply path for the exclusive use for a valve train, through which the lubricating oil is supplied directly to a camshaft or the like without letting the lubricating oil flow via an oil gallery.

A preferred embodiment of the present invention will be described with reference to FIGS. 1 through 12.

Figure 1:
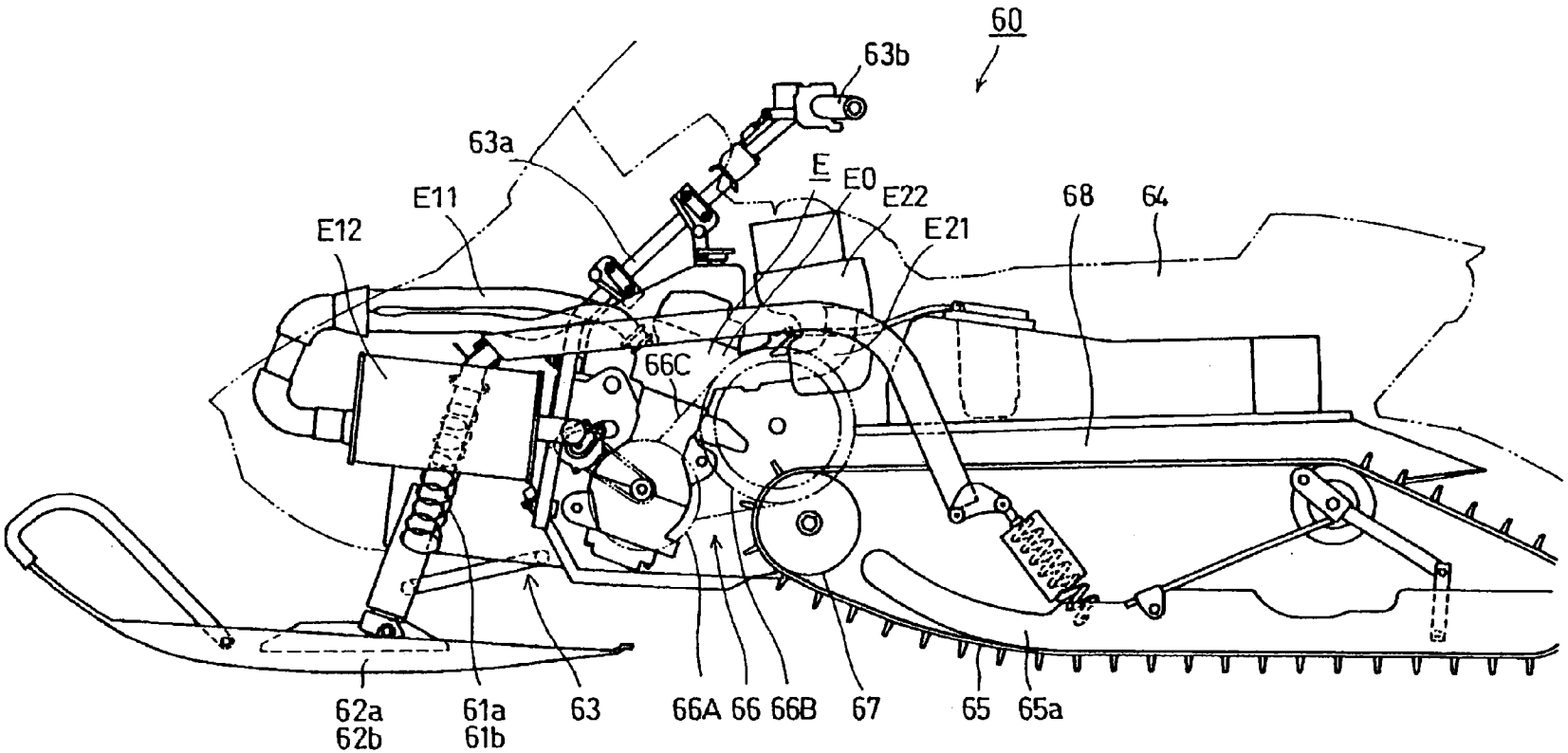
FIG. 1 is a side elevational view showing a snow vehicle mounted with an internal combustion engine according to the present invention, with exterior covers and the like thereof removed to show a principal structural section thereof.
Figure 2:
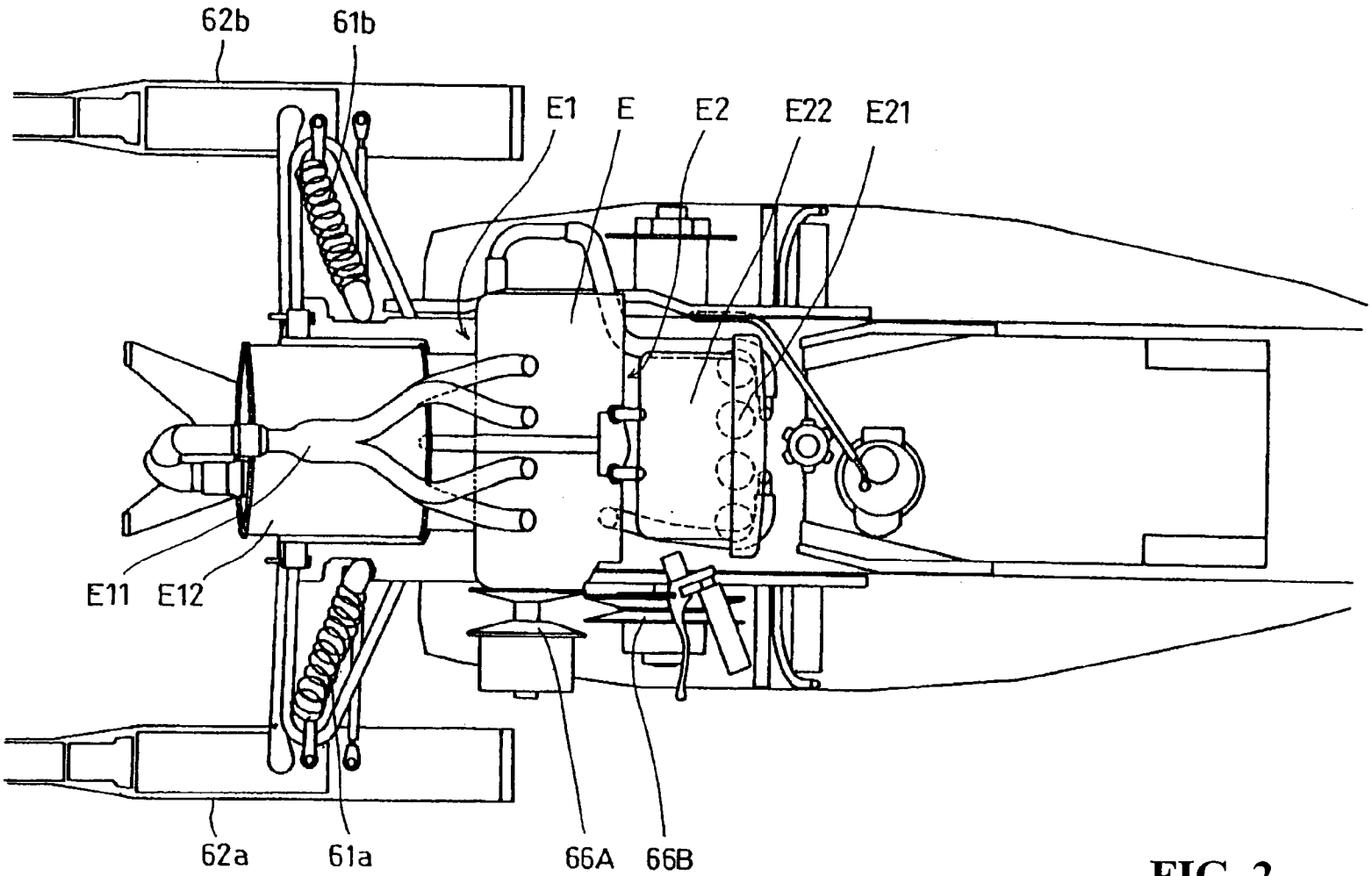
FIG. 2 is a top view showing the snow vehicle mounted with the internal combustion engine according to the present invention, with exterior covers, a seat, and the like thereof removed to show a principal structural section thereof.

FIG. 1 is a general side elevational view showing a snow vehicle 60 in which an internal combustion engine E according to the present invention is mounted. FIG. 2 is a general top view showing the snow vehicle 60. As can be understood from FIGS. 1 and 2, the internal combustion engine E is mounted at a location nearer a front side of a vehicle body of the snow vehicle 60. Right and left front suspensions 61*a*, 61*b* are provided at a front portion of the vehicle body. Steering control skis 62*a*, 62*b* are connected to the front suspensions 61*a*, 61*b*, respectively.

The steering control skis 62*a*, 62*b* are connected to a handlebar 63*b* located substantially at a central portion of the vehicle body by way of a steering shaft 63*a* and members of a steering system 63 including an arm pivot, a link rod, and the like. These members of the steering system 63 are disposed so as to pass through a front portion of the internal combustion engine E. A seat 64, on which an occupant sits, is disposed on the vehicle body rearward of the handlebar 63*b*.

There is also provided a V-belt type automatic transmission 66. The V-belt type automatic transmission 66 includes a drive pulley 66A and a driven pulley 66B. The drive pulley 66A and the driven pulley 66B constitute a driving portion for transmitting a driving force of the internal combustion engine E mounted nearer the front side of the vehicle body to an endless track belt 65 for running the snow vehicle 60. A rotational driving force with a speed changed by the automatic transmission 66 through a transmission method to be described later is transmitted to a drive wheel 67. This drives the endless track belt 65, thereby providing the snow vehicle 60 with a running drive. A radiator 68 is disposed below the seat 64.

Figure 3:
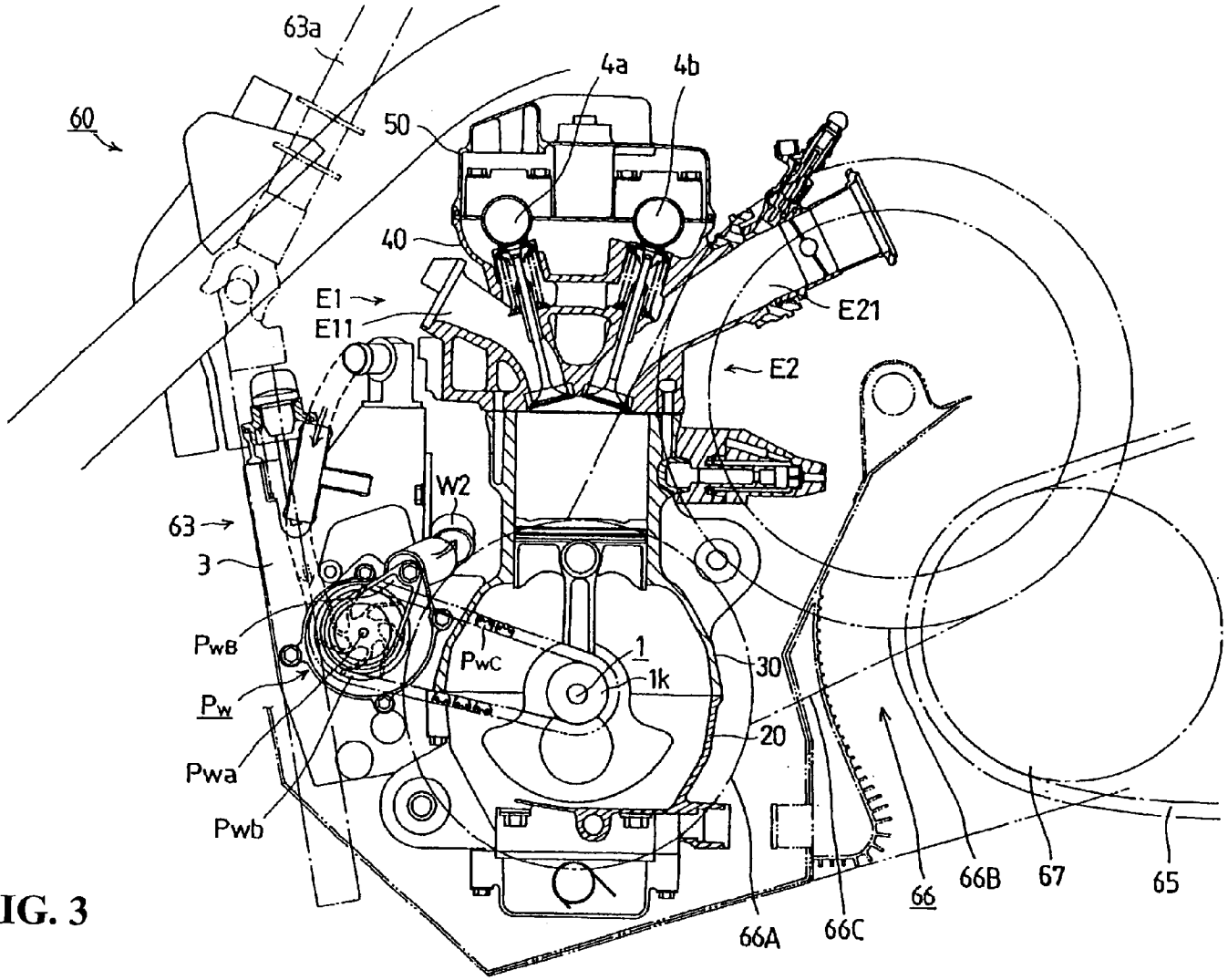
FIG. 3 is an enlarged side elevational view showing a section near a portion in which the internal combustion engine according to the present invention is mounted in the snow vehicle.

As evident from reference to FIG. 1, 2, or 3, each of these figures shows an intake pipe E21 and an exhaust pipe E11. The intake pipe E21 extends rearwardly of the vehicle body from a rear portion of the engine E. The intake pipe E21 is then bent upwardly. An air cleaner E22 is disposed on the upwardly bent portion of the intake pipe E21. As can be understood from FIG. 2, four exhaust pipes E11 extend from the front portion of the engine E toward the front portion of the vehicle body. As the exhaust pipes E1 extend forwardly, the pipes E11 converge first into two each and eventually into one. The pipes E11 converged into one at the front and are then curved into a U shape. The U-shaped portion again extends toward a rear portion of the vehicle body, forming a rearward bent portion. A muffler E12 is then disposed to the rearward bent portion.

FIG. 3 is an enlarged view showing the construction of an area near the location in which the internal combustion engine E is mounted. FIG. 3 also shows a frame forming part of the vehicle body and the V-belt type automatic transmission 66 forming part of the driving portion. FIG. 3 further shows part of the steering system 63 and the like, such as the steering shaft 63*a* and the like. The engine E mounted on the vehicle body is mounted such that a cylinder portion E0 thereof takes a position of being inclined slightly rearwardly (see FIG. 1). The left-hand side of the engine E shown in FIG. 3 is a front portion E1 of the engine E facing forward of the vehicle body of the snow vehicle 60. The front portion E1 is on an exhaust side. Accordingly, the exhaust pipes E11 described earlier extend from the front portion E1.

Figure 4:
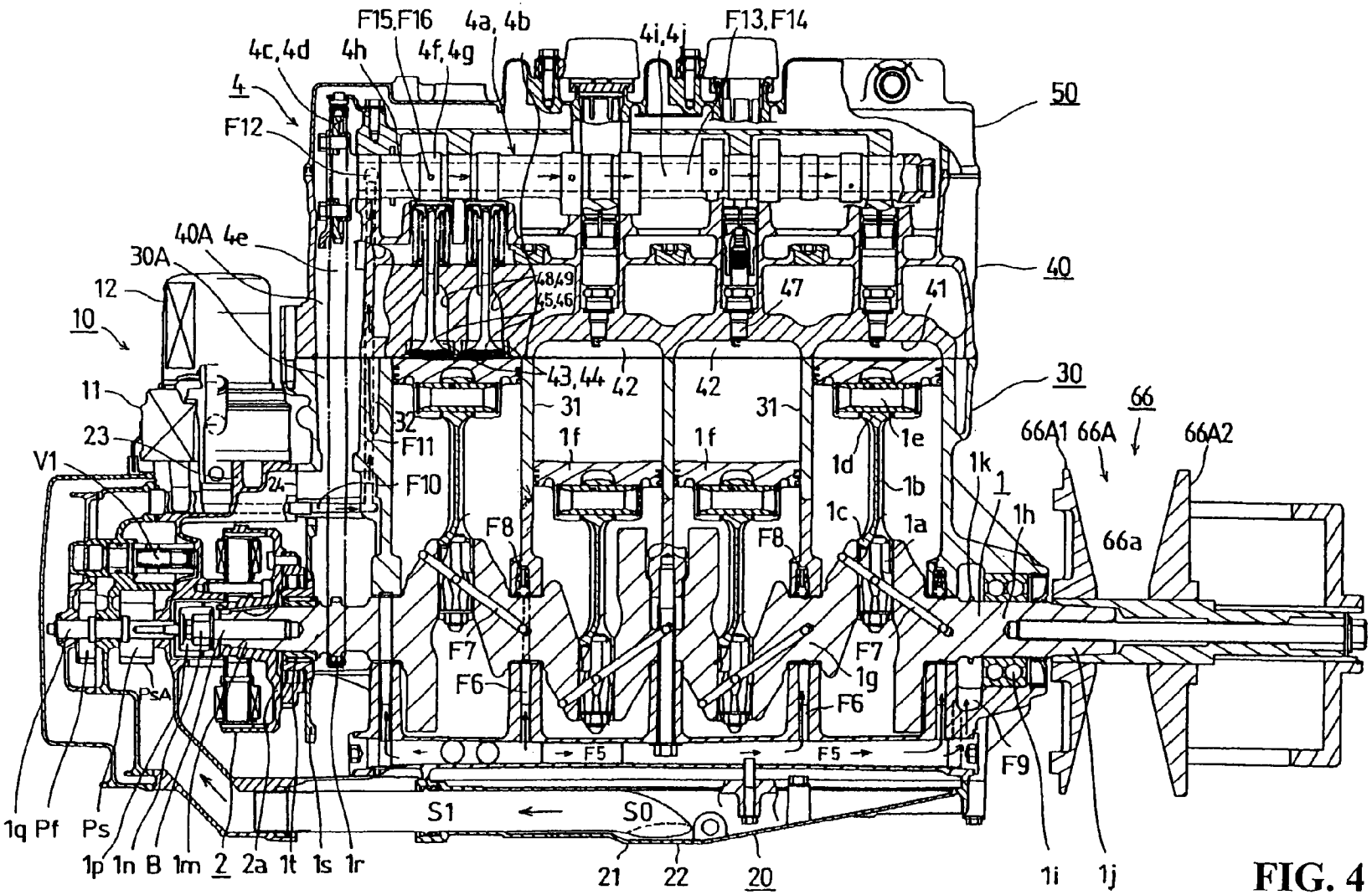
FIG. 4 is a longitudinal cross sectional view showing a principal structural section of the internal combustion engine according to the present invention.

FIG. 4 is a longitudinal cross-sectional view showing a principal part of the internal combustion engine E. Referring to FIG. 4, the engine E includes a main body structure including a crankcase 20, a cylinder block 30, a cylinder head 40, and a cylinder head cover 50. A crankshaft 1 is rotatably mounted in the crankcase 20. A big end portion 1*c* of a connecting rod 1*b* is rotatably supported on each of four crankpins 1*a* of the crankshaft 1. A piston 1*f* is mounted via a piston pin 1*e* to each of small end portions 1*d* of the connecting rods 1*b*. As can be understood from the foregoing description, the internal combustion engine E according to the preferred embodiment of the present invention is an in-line four-cylinder, four-cycle engine.

The crankshaft 1 is supported by journals 1*g* at five places in the crankcase 20. The crankshaft 1 is further supported by a ball bearing 1*i* at a position nearer a rightward end 1*h* thereof. The ball bearing 1*i* is placed in consideration of the presence of the V-belt type automatic transmission 66 described earlier. There is provided a rightwardly extended shaft portion 1*j* extending outwardly from a bearing mounting portion incorporating the ball bearing 1*i*. The drive pulley 66A of the V-belt type automatic transmission 66 is mounted to this rightwardly extended shaft portion 1*j*.

As touched upon earlier, the V-belt type automatic transmission 66 transmits the rotational driving force having a speed changed by the automatic transmission 66 to the drive wheel 67 for making the vehicle operate. More specifically, referring to FIGS. 1 and 3, the rotational driving force of the drive pulley 66A is transmitted to the driven pulley 66B via a V-belt 66C at a desired reduction ratio (gear ratio). The rotational driving force is then transmitted from the driven pulley 66B to a sprocket not shown and coaxial with the drive wheel 67 by way of a sprocket not explicitly shown and coaxial with the driven pulley 66B. Transmission of the driving force between the two sprockets is achieved by a chain or the like not shown and wound around the two sprockets.

The rotational driving force transmitted to the sprocket coaxial with the drive pulley 67 drivingly rotates the drive wheel 67. This causes the endless track belt 65 for running the snow vehicle 60 to be drivingly rotated as being guided by and along a slide rail 65*a*. The snow vehicle 60 is thereby available to be operated.

The V-belt type automatic transmission 66 will hereinafter be briefly described with reference to FIG. 5. When the engine E runs at low speed or remains stationary, the drive pulley 66A and the driven pulley 66B are held in their respective specific positions as detailed in the following by a force of a spring not shown disposed on the side of the driven pulley 66B. More specifically, the drive pulley 66A is retained in such a position that the width of a V-groove 66*a* is widened, that is, a substantial effective diameter of the drive pulley 66A is made smaller. The driven pulley 66B is retained in such a position that the width of a V-groove 66*b* is narrowed, that is, a substantial effective diameter of the driven pulley 66B is made larger.

Figure 5:
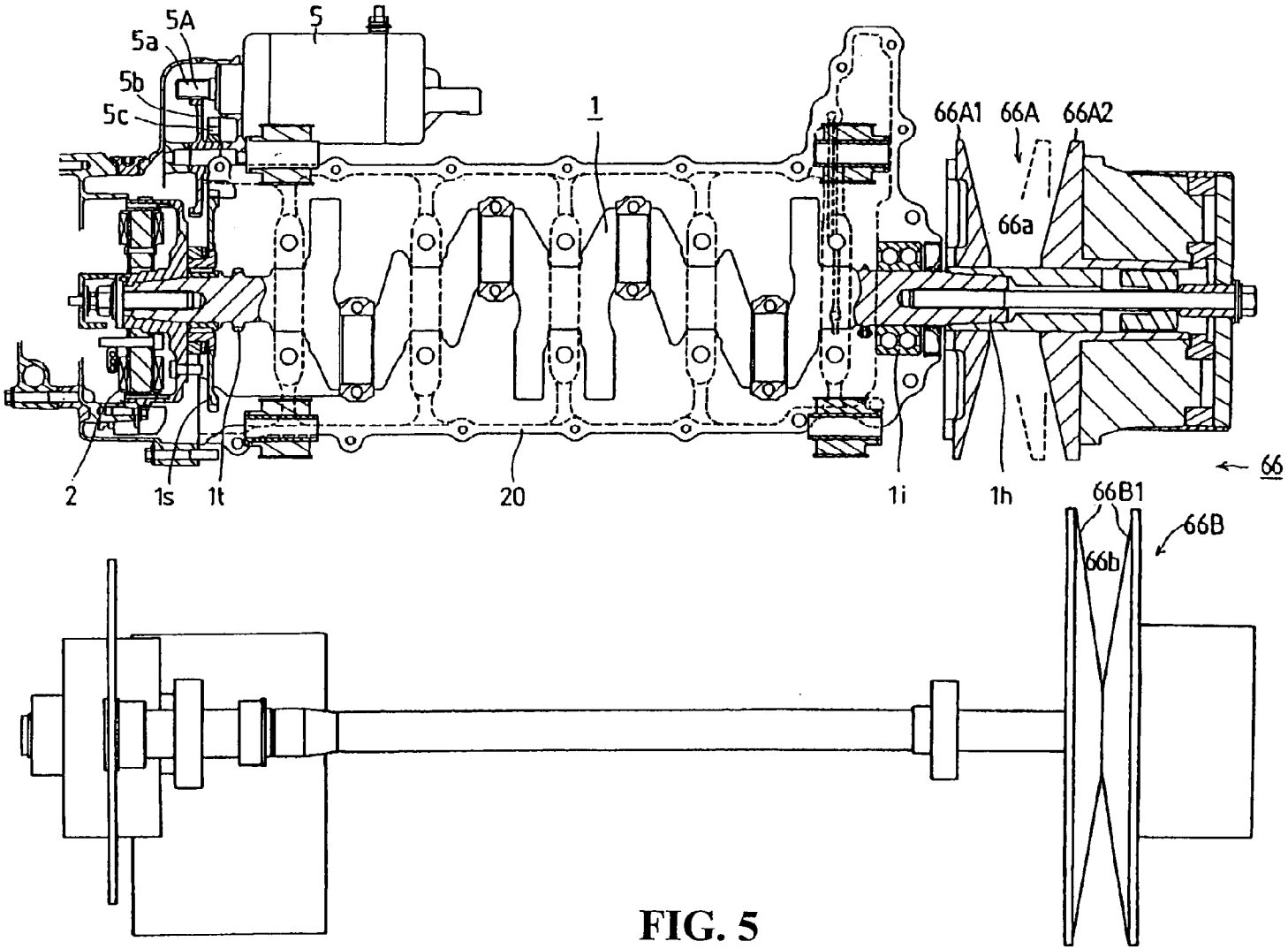
FIG. 5 is a view showing a structural section of a V-belt type automatic transmission in a snow vehicle drive mechanism according to the present invention.

A movable pulley piece 66A2 of the drive pulley 66A is fitted with a weight member not shown in FIG. 5. The weight member acts to change the reduction (gear) ratio applicable to the V-belt type automatic transmission 66. The weight member moves in a diametric direction of the movable pulley piece 66A2 through a centrifugal force acting in accordance with the rotation of the engine E (crankshaft 1). The movable pulley piece 66A2 thereby moves in a direction to change the width of the V-groove 66*a*. This results in the reduction ratio being changed. Overall, the V-belt type automatic transmission 66 achieves an automatic continuously variable change of speed.

That is, when the engine E (crankshaft 1) turns at high speed, the weight member not shown counteracts the force of the spring (the spring disposed on the side of the driven pulley 66B) to move the movable pulley piece 66A2 outwardly in the diametric direction through the action of the centrifugal force. The movable pulley piece 66A2 is thereby moved in a direction to narrow the width of the V-groove 66*a* of the drive pulley 66A. The V-belt 66C wound around the V-groove 66*a* then is displaced such that a position of contact thereof with the V-groove 66*a* is moved outwardly in the diametric direction. The substantial effective diameter of the drive pulley 66A is then made greater.

The outward displacement in the diametric direction of the position of contact of the V-belt 66C on the side of the drive pulley 66A results in the following corresponding movement on the side of the driven pulley 66B. More specifically, a pulley piece 66B1 overcomes the force of the spring not shown to move in a direction to widen the width of the V-groove 66*b*. This makes smaller the substantial effective diameter of the driven pulley 66B, reducing the reduction ratio. The endless track belt 65 is driven at this reduction ratio. The snow vehicle 60 is then operated at a high speed.

When the engine E (crankshaft 1) runs at a low speed, the weight member is located inwardly in the diametric direction of the movable pulley piece 66A2. The movable pulley piece 66A2 is then displaced in a direction to widen the width of the V-groove 66*a*. This results in the substantial effective diameter of the drive pulley 66A being made smaller. In the driven pulley 66B, on the other hand, the width of the V-groove 66*b* is narrowed and the substantial effective diameter of the driven pulley 66B is made greater. The reduction ratio is then made greater. The endless track belt 65 is driven at this reduction ratio, causing the snow vehicle 60 to operate at a low speed. The V-belt type automatic transmission 66, such as the type described above, is well-known.

Referring again to FIG. 4, the following can be understood from FIG. 4. More specifically, a sprocket 1*k* having a small diameter is disposed at a position adjacent to a portion of the crankshaft 1 supported by the ball bearing 1*i* on the rightward end 1*h* of the crankshaft 1. A chain Pwc is mounted on this sprocket 1*k* and a sprocket Pwb disposed on a pump shaft Pwa of a coolant pump Pw to be described later. See FIGS. 3 and 12. Accordingly, the coolant pump Pw is driven by being operatively connected with the rotation of the crankshaft 1.

A rotor 2*a* of a generator 2 is mounted at a position near a leftward end 1*m* of the crankshaft 1. An extended shaft portion 1*n* is formed from a bolt B placed in the leftward end 1*m* of the crankshaft 1. An oil pump shaft 1*q*, coaxially connected to the leftward end 1*m* via a coupling 1*p*, is provided for the extended shaft portion 1*n*. Two oil pumps Pf, Ps are juxtaposed on the oil pump shaft 1*q*.

Of the two oil pumps Pf, Ps juxtaposed on the oil pump shaft 1*q*, the oil pump Pf is a lubricating oil supply feed pump. While the other oil pump Ps is a scavenging pump for returning oil accumulated in a bottom portion 21 of the crankcase 20 to a dry sump oil tank 3. Supply of the lubricating oil and oil feeding action of the two oil pumps Pf, Ps will be described later and is omitted here.

A sprocket 1*r* having a small diameter is mounted at a position nearer the leftward end 1*m* of the crankshaft 1. The sprocket 1*r* is for driving two camshafts 4*a*, 4*b* of a valve train 4. A cam chain 4*e* is mounted on sprockets 4*c*, 4*d* mounted on the camshafts 4*a*, 4*b* and the sprocket 1*r*. This allows rotation of the crankshaft 1 to be transmitted to the two camshafts 4*a*, 4*b* at a half speed.

A gear 1*s* having a relatively large diameter is mounted via a one-way clutch 1*t* adjacent to the sprocket 1*r*. The gear 1*s* is for a starter motor 5, see FIG. 5. The gear 1*s* is operatively associated and coupled to a gear 5*a* that is integral with a motor shaft 5A of the starter motor 5 through meshing of intermediate gears 5*b*, 5*c*, see FIG. 5.

The cylinder block 30 is connected to an upper portion of the crankcase 20. Four cylinder holes 31 passing through the cylinder block 30 are disposed to be mutually parallel with each other in the cylinder block 30. The piston 1*f* makes a sliding motion in each of these four cylinder holes 31. The cylinder head 40 is connected to an upper portion of the cylinder block 30.

Four combustion chambers 42 are formed by four recessed portions 41 formed downwardly of the cylinder head 40 and the upper portions of the four cylinder holes 31 in the cylinder head 40. Each of the four combustion chambers 42 includes the following parts: more specifically, intake and exhaust ports 43, 44 for intake and exhaust; intake and exhaust valves 45, 46 for opening or closing the intake and exhaust ports 43, 44, respectively; a spark plug 47; and the like.

Intake and exhaust paths 48, 49 are formed in the cylinder head 40. The intake and exhaust paths 48, 49 communicate with the intake and exhaust ports 43, 44, respectively, disposed in the combustion chamber 42. There is disposed at the upper portion of the cylinder head 40 the valve train 4 for operating the intake and exhaust valves 45, 46. The valve train 4 includes cams 4*f*, 4*g*, the (two) camshafts 4*a*, 4*b*, driving mechanisms for the cams 4*f*, 4*g* and the camshafts 4*a*, 4*b*, tappets 4*h*, and the like. The cylinder head cover 50 is mounted on the upper portion of the cylinder head 40.

Figure 6:
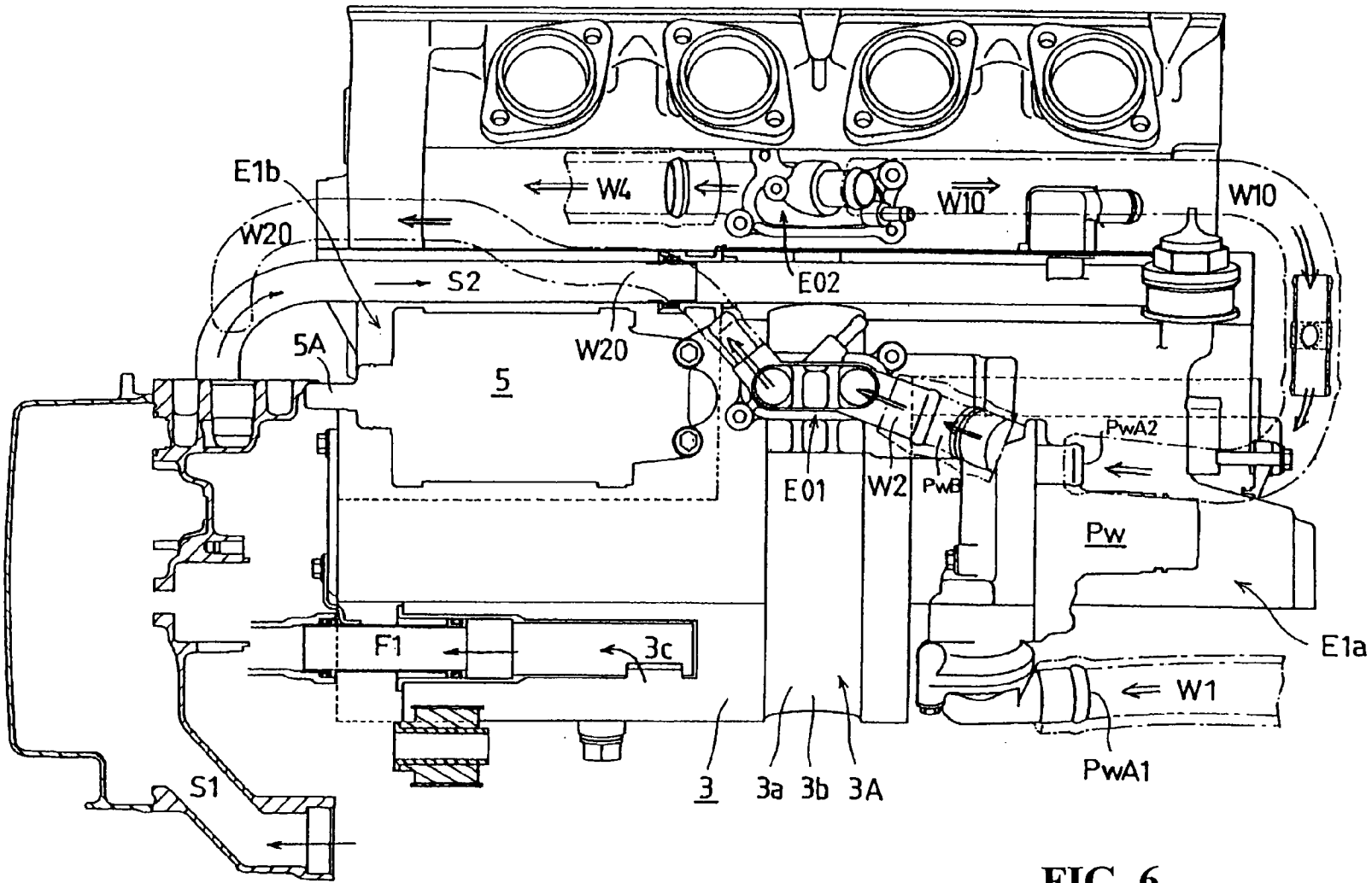
FIG. 6 is a view showing an exterior structure of the internal combustion engine according to the present invention on a front side in a vehicle forward direction.
Figure 7:
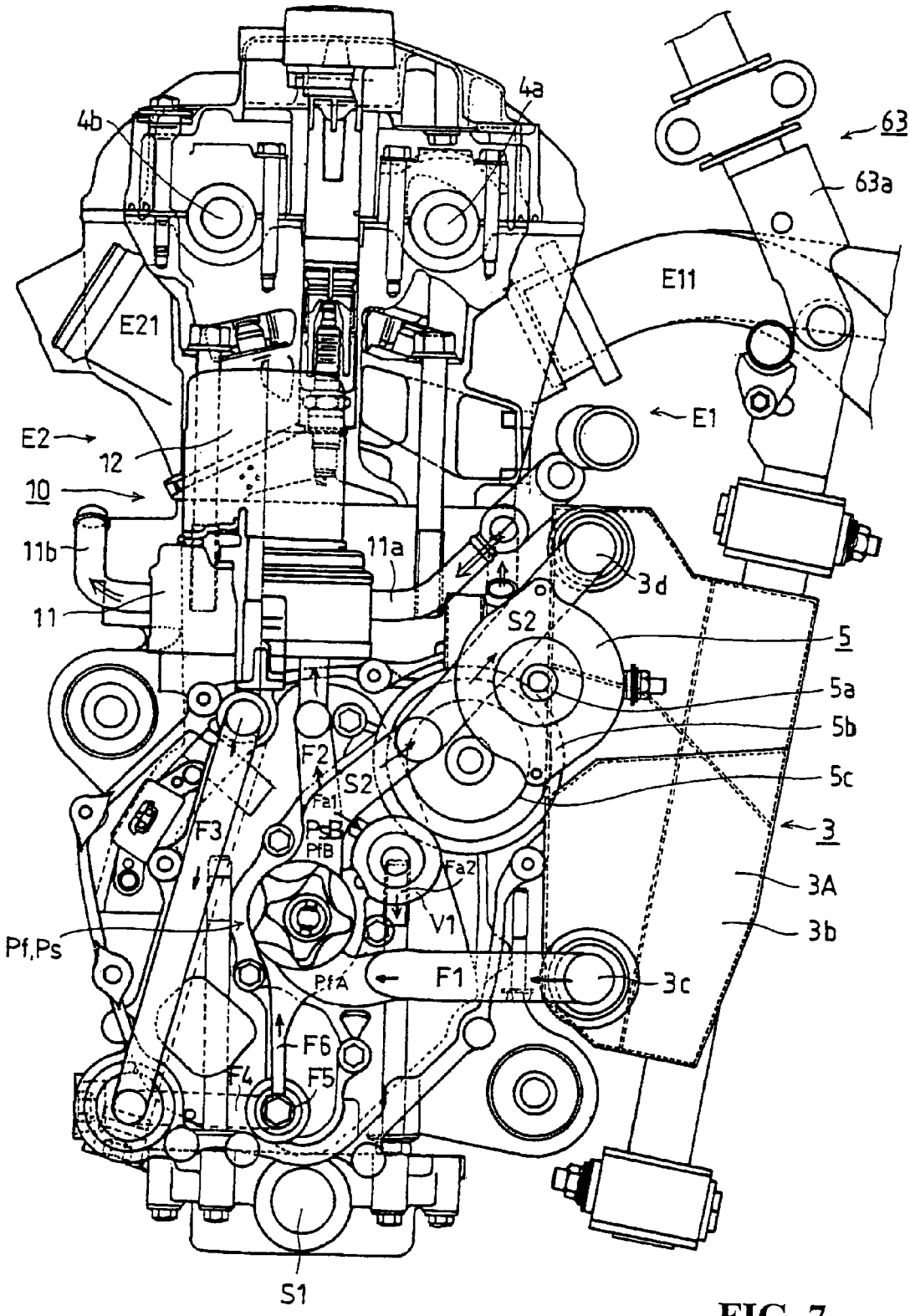
FIG. 7 is a side elevational view showing a principal structural section of the internal combustion engine according to the present invention.
Figure 8:
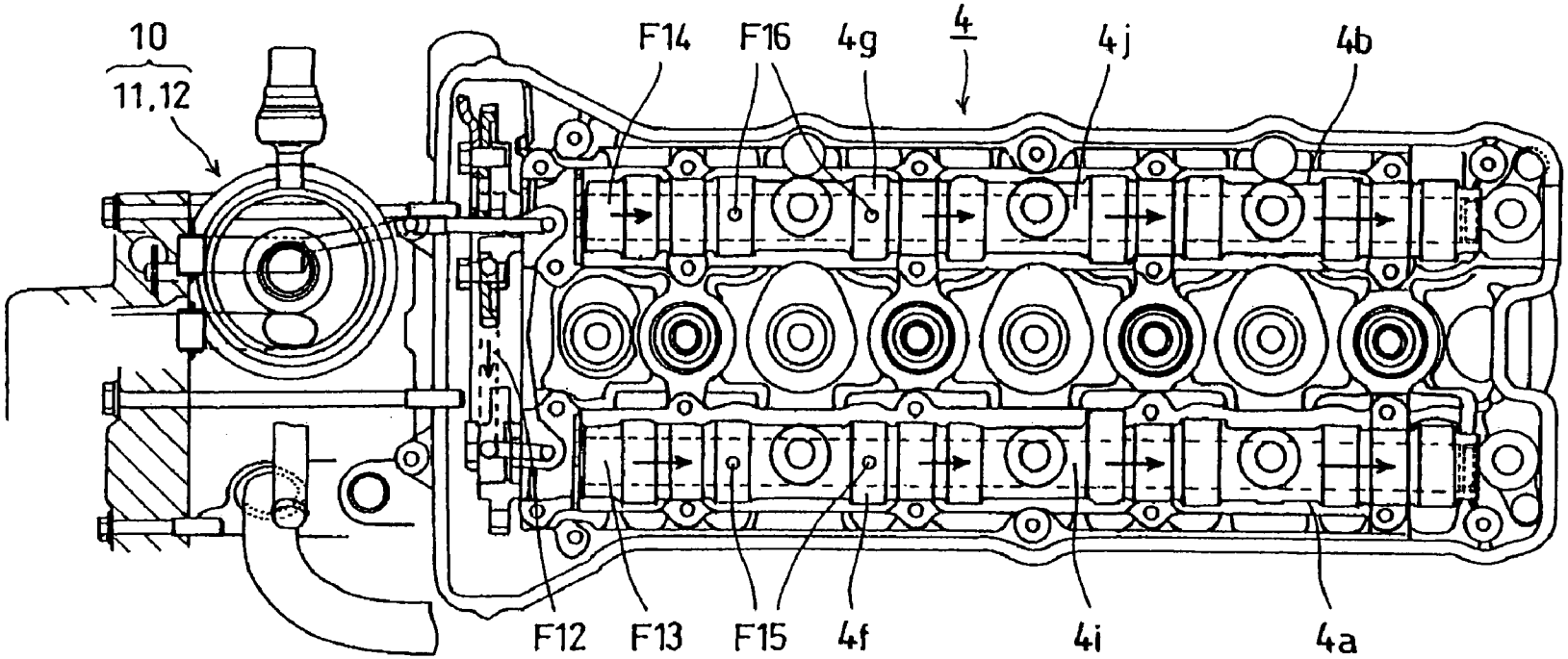
FIG. 8 is a top view showing a predetermined section of the internal combustion engine according to the present invention.

As shown in FIGS. 3, 7, and the like, the dry sump oil tank 3 is disposed at a front portion E1 of the engine E at a position corresponding to a wall portion of the crankcase 20 and the cylinder block 30 of the engine E. This specific position corresponds to a portion in the front portion E1 of the wall portion that is perpendicular to the engine E mounted in the vehicle in a vehicle forward direction. The dry sump oil tank 3 has a length covering substantially the entire width of the front portion E1. The dry sump oil tank 3 has a unique shape in a front view thereof as viewed from the direction of the front portion E1 of the engine E. Referring to FIG. 6, a rectangular cutout space portion E1*a* is formed on a downward portion on the right-hand side of the dry sump oil tank 3. Further, a rectangular cutout space portion E1*b* is formed on an upward portion on the left-hand side of the dry sump oil tank 3.

The coolant pump Pw is mounted in the front portion E1 of the engine E by being located in the space portion E1*a* formed by the cutout on the downward portion on the right-hand side of the dry sump oil tank 3. The coolant pump Pw is accommodated in the space portion E1*a* in the following specific orientation. More specifically, the pump Pw is disposed with a coolant intake port PwA1 thereof located downwardly and a coolant discharge port PwB located upwardly. The starter motor 5 is mounted in the front portion E1 of the engine E by being located in the space portion E1*b* formed by the cutout on the upward portion on the left-hand side of the dry sump oil tank 3. The starter motor 5 is accommodated in the space portion E1*b* in the following specific orientation. More specifically, the motor 5 is disposed with a projecting direction of the motor shaft 5A thereof pointing leftward in FIG. 6, that is, outwardly in a direction of width of the engine E.

A steering post 3A is formed at substantially a central portion 3*a* in the left-to-right direction of the dry sump oil tank 3 in the aforementioned front view. The steering post 3A is a recessed groove 3*b* having a substantially arcuate cross section. The steering post 3A is provided for the steering shaft 63*a*, see FIG. 7, connected in a row to the steering control handlebar 63*b* shown in FIG. 1 of the snow vehicle 60. The steering post 3A passes vertically through the dry sump oil tank 3. The steering shaft 63*a* is slightly obliquely oriented in passing through the dry sump oil tank 3 in the vertical direction. To receive this steering shaft 63*a*, the steering post 3A is oriented slightly obliquely so as to be aligned with the direction of the extension of the steering shaft 63*a*.

As can be understood from the foregoing and FIG. 6, the coolant pump Pw and the starter motor 5 are disposed so as to sandwich the steering post 3A at the front portion E1 of the engine E on the left and right thereof. The steering post 3A is formed as the recessed groove 3*b* passing through the dry sump oil tank 3 vertically at the central portion 3*a* in order to receive the steering shaft 63*a*.

Figure 11:
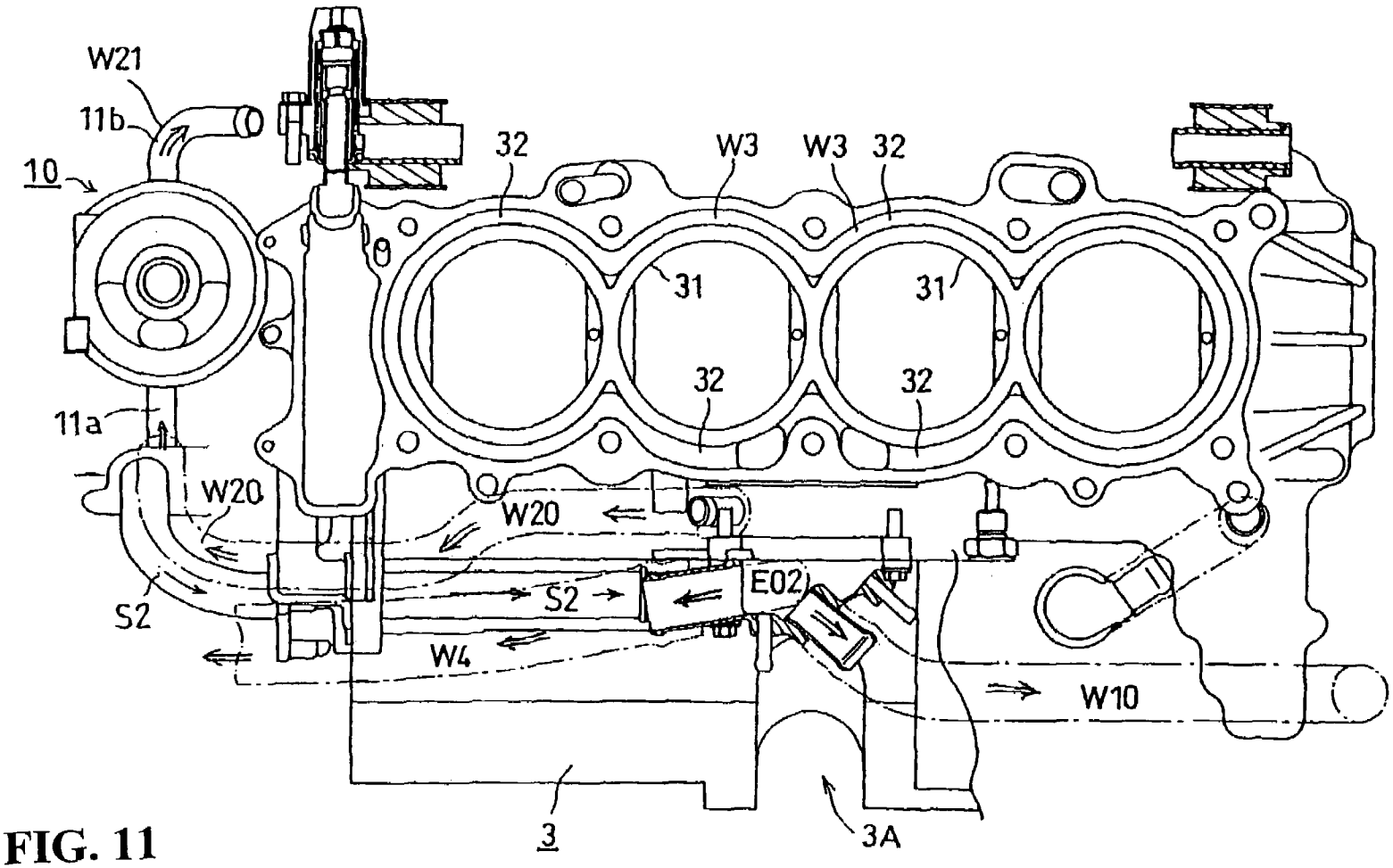
FIG. 11 is a view showing a principal structural section of a coolant supply path in the internal combustion engine according to the present invention.

Reference is now made to FIGS. 4, 7, 11. An oil cooler 11 and an oil filter 12 are disposed at a portion corresponding to the wall portion of the cylinder block 30 and the cylinder head 40 on a side portion, the left side surface in FIG. 4, running in parallel with the vehicle forward direction of the engine E and at a position substantially upwardly of the oil pumps Pf, Ps and the generator 2 at the leftward end 1*m* of the crankshaft 1. The oil cooler 11 and the oil filter 12 are integrated together. The aforementioned arrangement is achieved by mounting a downward structural portion of a unit 10 representing an integrated structure of the oil cooler 11 and the oil filter 12 in its mounting state on the upper portion of the crankcase cover 23.

The downward structural portion of the integrated unit 10 in its mounting state, that is, the downward structural portion that serves for mounting onto the upper portion of the crankcase cover 23 is formed as the oil cooler 11. The oil cooler 11 includes a heat exchanger of a cylindrical shape not explicitly shown. The oil cooler 11 further includes a coolant introduction pipe 11*a* and a coolant exhaust pipe 11*b* for the heat exchanger, see FIG. 11. An upper structural portion of the unit 10 is formed as the oil filter 12.

The internal combustion engine E according to the preferred embodiment of the present invention is generally constructed as described in the foregoing. A lubricating oil supply structure adopting what is called a dry sump method in the engine E will now be described.

Figure 10:
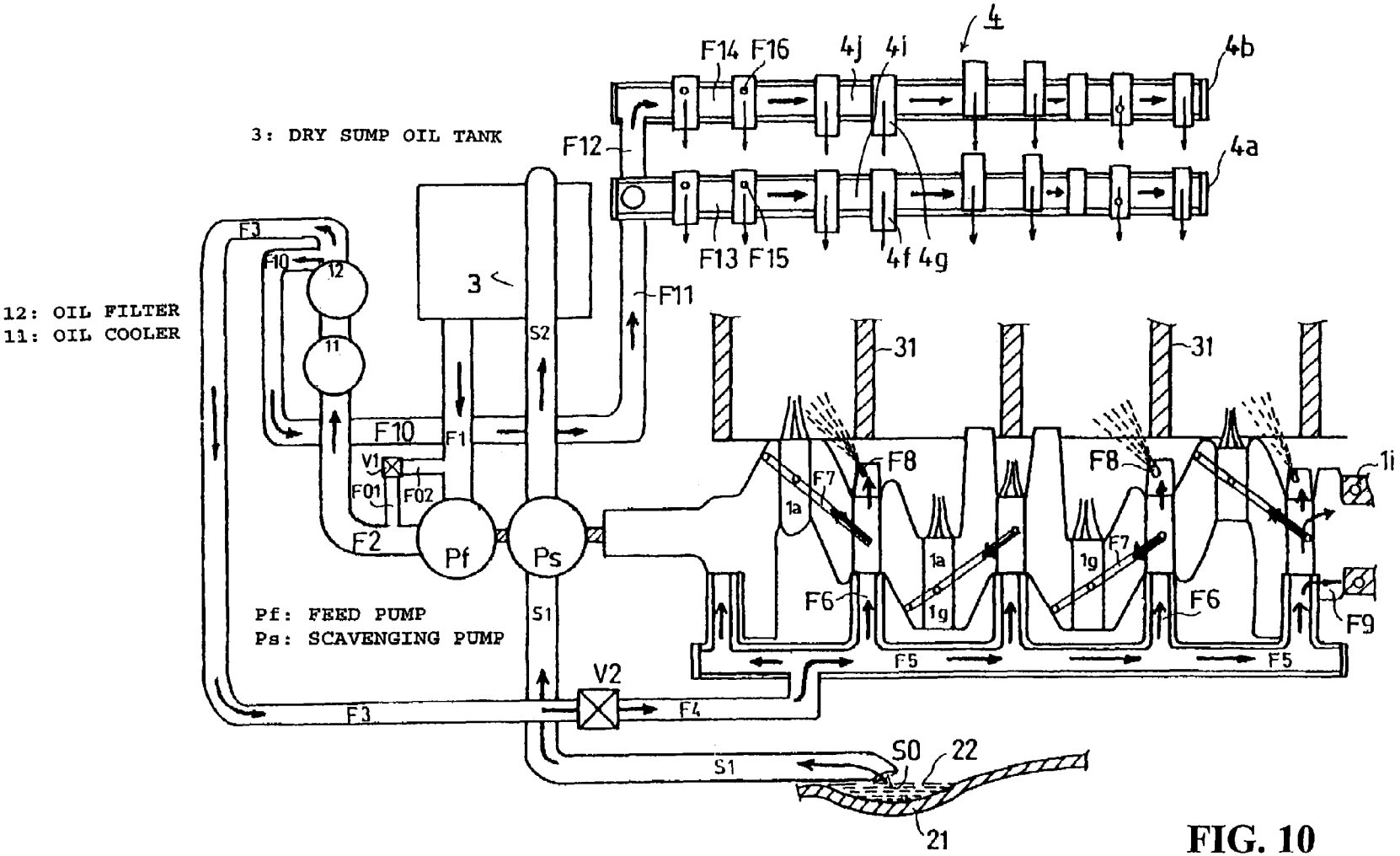
FIG. 10 is an explanatory schematic view showing a lubricating oil supply system in the internal combustion engine according to the present invention.

FIG. 10 shows a lubricating oil supply system according to the preferred embodiment of the present invention.

Figure 9:
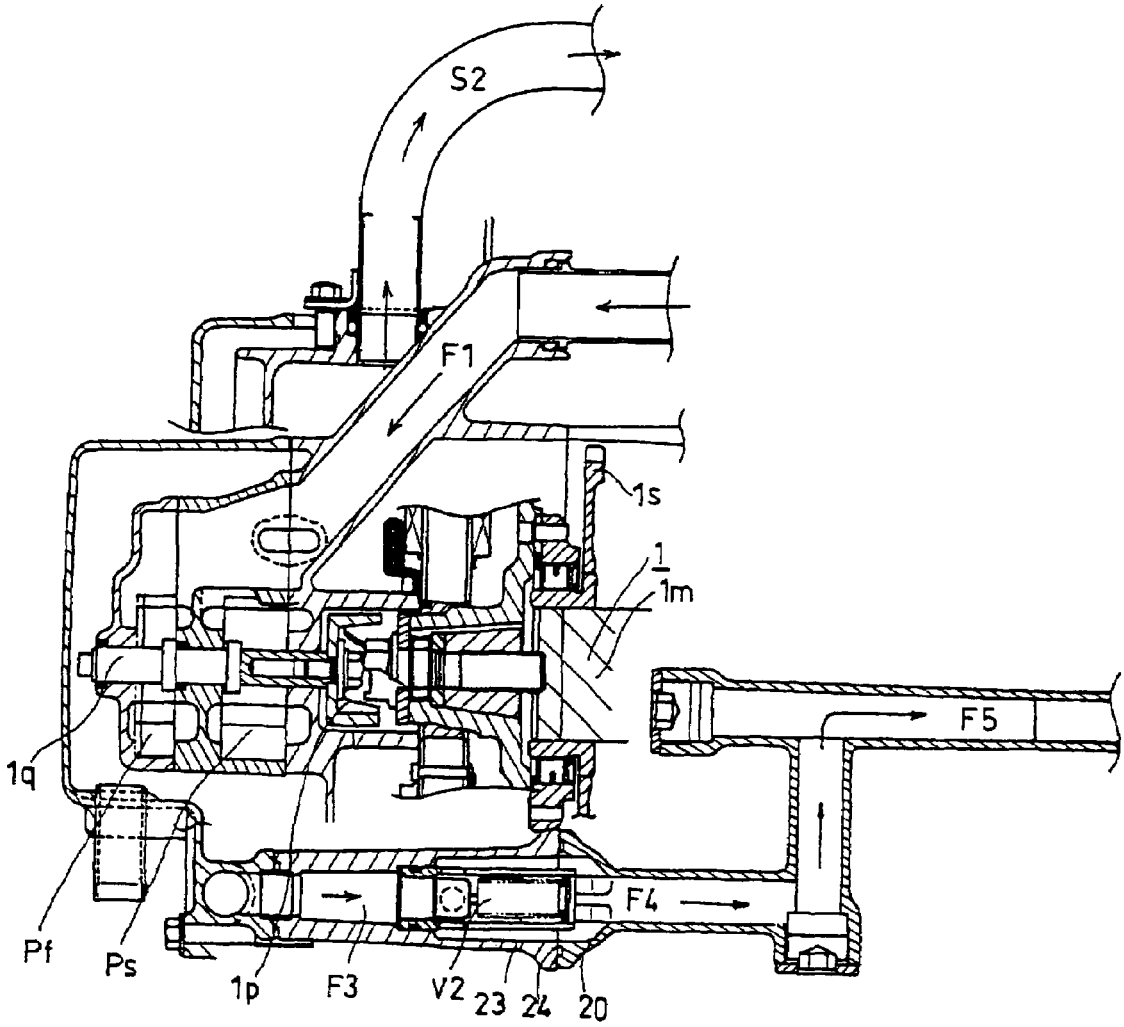
FIG. 9 is an enlarged cross-sectional view showing a principal structural section of a lubricating oil supply path in the internal combustion engine according to the present invention.

As described earlier, two oil pumps Pf, Ps, that is the feed pump Pf and the scavenging pump Ps, are juxtaposed on the oil pump shaft 1*q* at the leftward end 1*m* of the crankshaft 1 as shown in FIGS. 4 and 9. The oil pump shaft 1*q* is coaxial with, and rotated by being operatively connected to, the crankshaft 1.

Referring to FIG. 7, a suction port PfA of the feed pump Pf communicates with an opening 3*c* at a lower portion of the dry sump oil tank 3 via a lubricating oil suction oil path F1. A discharge port PfB of the feed pump Pf communicates with the unit 10 representing the integrated structure of the oil cooler 11 and the oil filter 12 via a lubricating oil supply path F2. The lubricating oil supply path F2 provides communication between the oil cooler 11 at the downward portion of the unit 10 and the discharge port PfB of the feed pump Pf. Accordingly, driving the feed pump Pf causes the lubricating oil in the dry sump oil tank 3 to be supplied to the unit 10.

The lubricating oil supply path F2 includes a branch oil path F01, see FIG. 10. A relief valve V1, see also FIGS. 1 and 7, is disposed on the branch oil path F01. The relief valve V1 functions to regulate a lubricating oil supply pressure in the lubricating oil supply path F2. The lubricating oil that has flowed from the relief valve V1 is to be returned to the lubricating oil suction oil path F1 through a branch oil path F02, see FIG. 10.

The lubricating oil is then supplied to the unit 10. The lubricating oil is filtered by the oil filter 12 and cooled by the oil cooler 11 in the unit 10. The lubricating oil is further supplied as follows as can be understood by referring to FIGS. 4, 7, 8, and 9. More specifically, the lubricating oil from a lubricating oil outlet port of the unit 10 is supplied to an oil gallery F5, camshafts 4*a*, 4*b* of the valve train 4, and the like through the branch supply paths. The branch supply paths include lubricating oil supply paths F3, F4, see FIG. 7, to the oil gallery F5 and lubricating oil supply paths F10, F11, see FIG. 4, to the valve train 4.

A check valve V2 is disposed, see FIG. 9, in the lubricating oil supply paths F3, F4 serving as the branch supply paths to the oil gallery F5 that communicates with the lubricating oil outlet port of the unit 10. The check valve V2 has a function with which an opening thereof is automatically adjusted according to the supply pressure of the lubricating oil. More specifically, the check valve V2 is provided with a flow rate control function for varying the flow rate according to the rotation of the engine. More specifically, the opening of the check valve V2 is made small to suppress a supply amount of the lubricating oil when the engine is operating at a low speed. The opening of the check valve V2 is made large to increase the supply amount of the lubricating oil when the engine is operating at a high speed. Accordingly, the supply amount of the lubricating oil to the oil gallery F5 is throttled when the engine is operating at a low speed. A sufficient amount of the lubricating oil is thereby supplied to the valve train requiring a greater amount of lubricating oil.

Disposition of the check valve V2 is achieved by using a joint 24 between the crankcase 20 and the crankcase cover 23.

Referring to FIG. 4, the oil gallery F5 extends in parallel with the crankshaft 1 at the downward portion thereof. The oil gallery F5 extends to cover substantially an entire length of the crankshaft 1. A number of paths and ports are brought into communication with the oil gallery F5 as detailed in the following. More specifically, these paths and ports include: a plurality of lubricating oil supply paths F6, F7 communicating with journals 1*g* and crankpins 1*a*, to which connecting rods 1*b* are connected, of the crankshaft 1; lubricating oil injection ports F8 for inner wall portions of the cylinder holes 31; and a lubricating oil supply path F9 communicating with the ball bearing 1*i* on the rightward end 1*h* of the crankshaft 1.

The lubricating oil supply paths F10, F11 communicating with the camshafts 4*a*, 4*b* of the valve train 4 are so-called lubricating oil supply paths for the exclusive use for the valve train 4. The lubricating oil from the lubricating oil supply paths F10, F11 does not flow through the oil gallery F5. As shown in FIG. 4, the lubricating oil supply path F10 branches off an oil outlet path of the unit 10, extends horizontally, is routed through the joint 24 between the crankcase 20 and the crankcase cover 23, and is in communication with the lubricating oil supply path F11.

The lubricating oil supply path F11 in communication with the lubricating oil supply path F10 is bent substantially at right angles from the lubricating oil supply path F10. The supply path F11 then extends upwardly along opening portions 30A, 40A for the cylinder block 30 on the upper portion of the crankcase 20 and the cam chain 4*e* of the cylinder head 40, and along a water jacket 32 of the cylinder (see FIG. 4) inside the wall portion. The lubricating oil supply path F11 is thereby communicated with lubricating oil supply paths F13, F14 inside the camshafts 4*a*, 4*b* via a branch lubricating oil supply path F12. The lubricating oil supply paths F13, F14 inside the two camshafts 4*a*, 4*b* include a plurality of apertures F15, F16 opening in each of cam surfaces.

Reference is now made to the scavenging pump Ps juxtaposed with the feed pump Pf on the oil pump shaft 1*q*. A pump suction port PsA, see FIG. 4, of the scavenging pump Ps is connected to an oil path S1 for sucking oil accumulated in the bottom portion 21 of the crankcase 20 to be described later. Referring to FIG. 4, the oil path S1 for sucking accumulated oil extends up to an oil sump 22 located substantially at a central portion of the bottom portion 21 of the crankcase 20 from the pump suction portion PsA. There is provided an opening S0 at an extended end of the oil path S1. The opening S0 has a function of sucking the accumulated oil in the oil sump 22.

The oil path S1 for sucking accumulated oil has a structure of being in communication with the pump suction port PsA of the scavenging pump Ps as detailed below. More specifically, the oil path S1 extends from the oil sump 22 substantially in parallel with the bottom portion 21 of the crankcase 20. The oil path S1 also extends in parallel with the crankshaft 1 and the oil gallery F5 downwardly thereof.

Referring to FIG. 7, a discharge port PsB of the scavenging pump Ps is in communication with an upper portion opening 3*d* of the dry sump oil tank 3 through an accumulated oil return oil path S2. The oil path S2 extends substantially obliquely upwardly toward the upper portion of the dry sump oil tank 3 from the pump discharge port PsB in FIG. 7. Accordingly, because of the structure of the oil paths S1, S2 being in communication with the scavenging pump Ps, the oil accumulated in the bottom portion 21 of the crankcase is to be returned to the dry sump oil tank 3 as the scavenging pump Ps is driven.

As the crankshaft 1 is rotated through the drive of the internal combustion engine E, the two oil pumps Pf, Ps, or more specifically, the feed pump Pf and the scavenging pump Ps are driven. As shown in FIG. 7, driving the feed pump Pf causes the lubricating oil in the dry sump oil tank 3 to be pumped thereinto through the suction port PfA thereof by way of the lubricating oil suction oil path F1. As the pressure of the feed pump Pf is boosted, the lubricating oil is sent under pressure from the discharge port PfB of the feed pump Pf.

The lubricating oil sent under pressure from the discharge port PfB of the feed pump Pf is supplied through the lubricating oil supply path F2 to the unit 10 as the integral structure integrating the oil cooler 11 with the oil filter 12. The supply pressure in the lubricating oil supply path F2 is regulated by the relief valve V1 disposed on the branch oil path F01, see FIG. 10. The lubricating oil flowing out through a pressure regulating action by the relief valve V1 is returned again to the lubricating oil suction oil path F1 through the branch oil path F02, see FIG. 10.

The lubricating oil that has flowed into the unit 10 circulates therethrough. During this period, the lubricating oil is filtered by the oil filter 12 and cooled by the heat exchanger included in the oil cooler 11. The lubricating oil, which has been filtered and cooled in the unit 10, is supplied to the oil gallery F5, the camshafts 4*a*, 4*b* of the valve train 4, and the like through the lubricating oil supply paths F3, F4 and lubricating oil supply paths F10, F11, see FIG. 4.

The lubricating oil sent under pressure in the lubricating oil supply path F3 having communication with the oil gallery F5 pushes open the check valve V2, see FIG. 9, to flow through the lubricating oil supply path F4. The lubricating oil is then supplied to the oil gallery F5.

The lubricating oil supplied into the oil gallery F5 flows through the oil gallery F5 that extends along the crankshaft 1 downward thereof, see FIG. 4.

The lubricating oil that has flowed through the oil gallery F5 flows therefrom via the lubricating oil supply paths F6, F7. The lubricating oil is then supplied to the journals 1*g* and the crankpins 1*a*, to which the connecting rods 1*b* are connected, of the crankshaft 1. The lubricating oil is further supplied from the lubricating oil injection ports F8 to the inner wall portions of the cylinder holes 31 and through the lubricating oil supply path F9 to the ball bearing 1*i* on the rightward end 1*h* of the crankshaft 1. The lubricating oil is thus served for lubrication of different parts of the engine, see FIG. 4.

The lubricating oil that is sent under pressure to the lubricating oil supply paths F10, F11 in communication with the camshafts 4*a*, 4*b* of the valve train 4 will now be described. This part of the lubricating oil first flows through the lubricating oil supply path F10 and extends horizontally and passes through the joint 24 between the crankcase 20 and the crankcase cover 23. The lubricating oil then flows through the lubricating oil supply path F11. The supply path F11 is bent substantially at right angles from the supply path F10. The supply path F11 then extends upwardly along the opening portions 30A, 40A for the cam chain 4*e* in the cylinder block 30 and the cylinder head 40, and along the water jacket 32 of the cylinder inside the wall portion. See FIG. 4.

The lubricating oil that has flowed through the supply path F11 is branched into two streams after the branch lubricating oil supply path F12 at the upper portion of the supply path F11. The oil then flows through the lubricating oil supply paths F13, F14. The lubricating oil supply paths F13, F14 serve as hollow hole portions 4*i*, 4*j* inside the corresponding one of the two camshafts 4*a*, 4*b*, respectively. Two camshafts 4*a*, 4*b* are provided with the camshaft 4*a* on the intake side and the camshaft 4*b* on the exhaust side. The oil then flows out through the plurality of apertures F15, F16 opening in each of cam surfaces of the lubricating oil supply paths F13, F14. The oil thus serves for lubricating and cooling the cam surface of cams 4*f*, 4*g*, a tappet 4*h*, and the like. See FIGS. 4 and 8. The return oil after lubrication is returned to the oil sump 22 at the bottom portion 21 of the crankcase 20 through a return oil path and the like not shown inside the wall portion of the cylinder block 30.

Though not explicitly shown in the figures or explained, supply paths for supplying drive units and the like of other auxiliaries are appropriately provided.

The lubricating oil that has serves for lubricating different parts of the engine E as described above drips in the engine E and is returned to the oil sump 22 at the bottom portion 21 of the crankcase 20 through appropriate return oil paths not shown. See FIG. 4.

As described in the foregoing, the lubricating oil serves for lubrication of different parts mentioned above of the internal combustion engine E and then drips or flows to the oil sump 22 at the bottom portion 21 of the crankcase 20. That part of lubricating oil is pumped up from the suction port PsA of the scavenging pump Ps through the oil path S1 for sucking accumulated oil by the scavenging pump Ps, which is driven with the feed pump Pf. The lubricating oil is then returned to and recovered in the dry sump oil tank 3 through the accumulated oil return oil path S2, in which a pump pressure is boosted in the scavenging pump Ps. See FIGS. 4 and 7. The lubricating oil again serves for lubrication of different parts of the engine E as described above through the aforementioned paths of lubricating oil supply.

A cooling structure in the internal combustion engine E will now be described.

Referring to FIG. 6, the coolant pump Pw is disposed in the cutout space portion E1*a* in the dry sump oil tank 3 disposed at the front portion E1 of the internal combustion engine E. As described earlier, the coolant pump Pw is drivingly rotated in synchronism with the rotation of the crankshaft 1 through the chain Pwc mounted on the sprocket 1*k* disposed nearer the rightward end 1*h* of the crankshaft 1, see FIGS. 3 and 4, and the sprocket Pwb mounted on the coolant pump shaft Pwa, see FIGS. 3 and 12.

Figure 12:
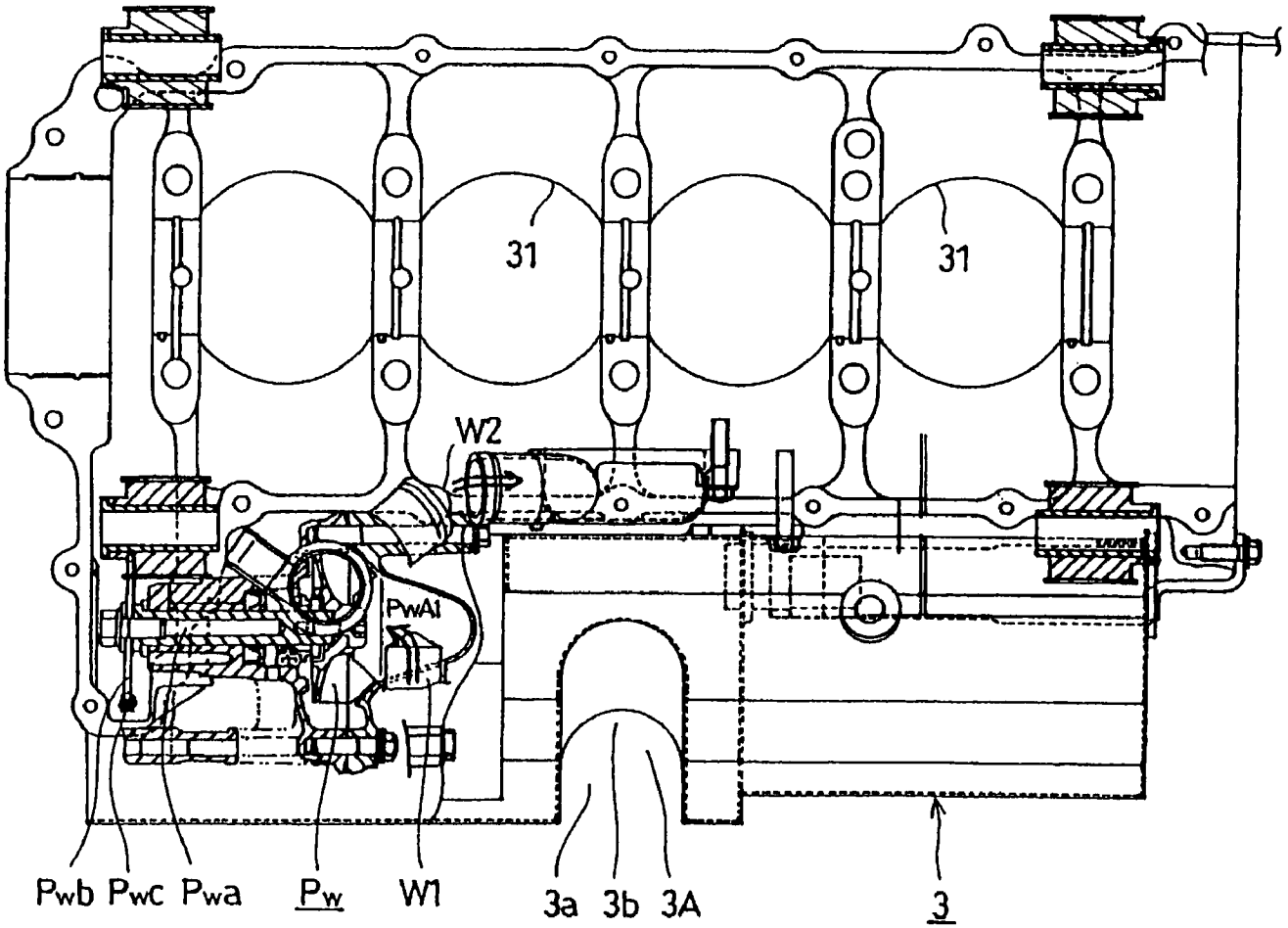
FIG. 12 is a view showing part of a major coolant supply structure in the internal combustion engine according to the present invention.
Figure 13:
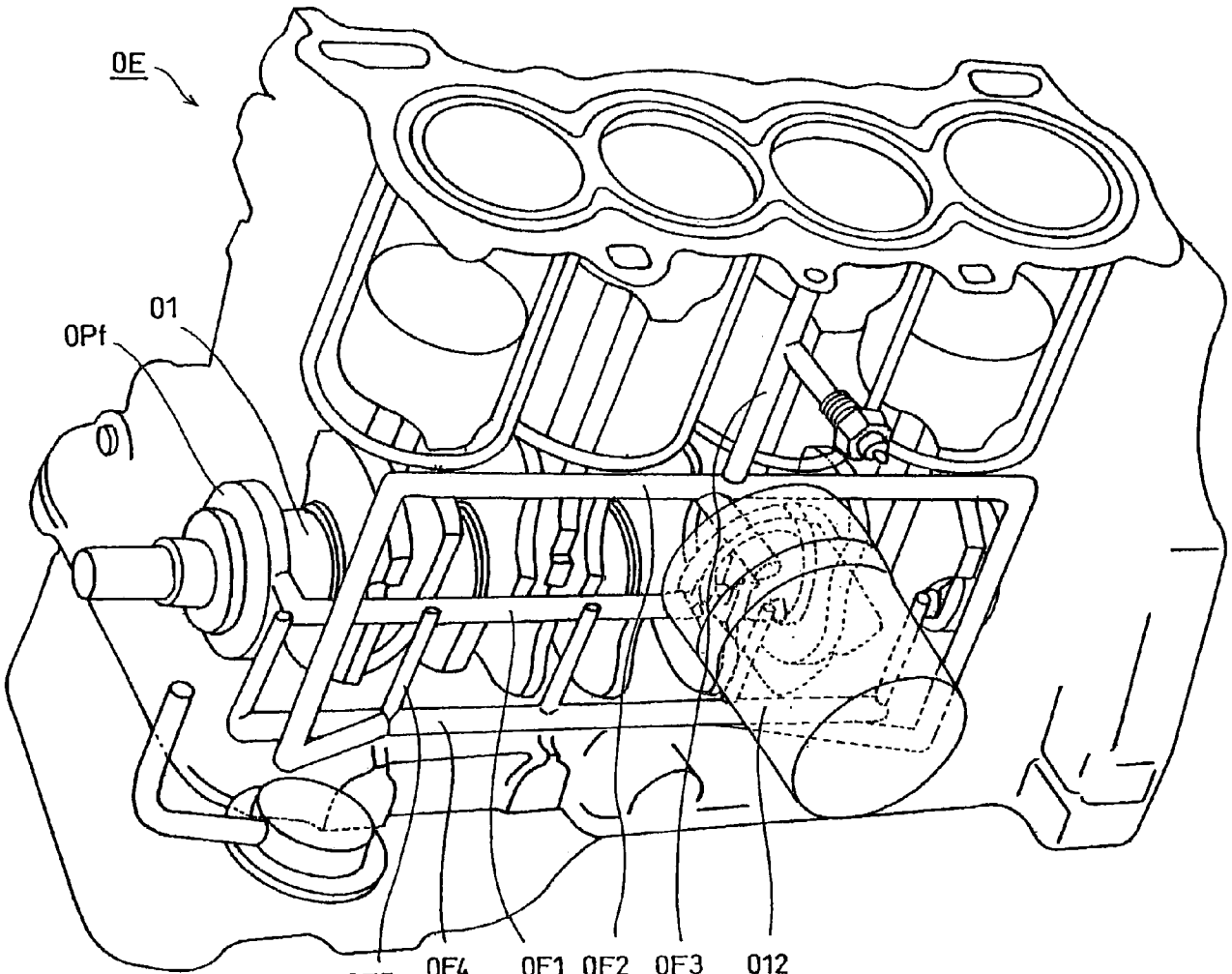
FIG. 13 BACKGROUND ART
FIG. 13 is a view showing a lubricating oil supply structure in a conventional internal combustion engine.

As can be understood by referring to FIGS. 6 and 12, there is included a coolant return path W1. The coolant return path W1 provides communication between the coolant intake port PwA1 of the coolant pump Pw and a coolant outlet of the radiator 68, see FIG. 1, not shown in either FIG. 6 or 12 and disposed downwardly of the seat 64 of the snow vehicle 60. There is also included a coolant supply path W2. The coolant supply path W2 provides communication between the coolant discharge port PwB of the coolant pump Pw and a coolant introduction port E01 for introducing coolant to the engine E. The coolant supply path W2 is located at the center of the front portion E1 of the engine E. There is further included a coolant supply path W3. The coolant supply path W3 includes the water jacket 32 and the like for guiding the coolant introduced through the coolant introduction port E01 located at the center of the front portion E1 of the engine E to areas around the cylinder holes 31 of the engine E. See FIG. 11.

Further, there is included a coolant path W4. The coolant path W4 provides communication between an outlet of the coolant supply path W3, that is, a coolant exit port E02 for the coolant coming out of the engine E, and a coolant inlet of the radiator 68. The coolant path W4 includes a thermostat and a reservoir tank not shown which is interposed therebetween. In addition, there is disposed a bypass coolant path W10, see FIGS. 6 and 11, that branches off the thermostat. The bypass coolant path W10 is for cooling (warm-up operation) when the coolant temperature is low. The bypass coolant path W10 is in communication with a suction port PwA2, see FIG. 6, of the coolant pump Pw.

The coolant introduction port E01 for introducing coolant to the engine E is located substantially at the central portion of the cylinder block 30 in the vertical direction. The coolant exit port E02 for the coolant coming out of the engine E is, on the other hand, located at an upper portion of the cylinder block 30 in the vertical direction. Accordingly, the coolant introduction port E01 and the coolant exit port E02 are disposed in the cylinder block 30 in a vertical positional relationship relative to each other, see FIG. 6.

In addition, a coolant supply path W20 is disposed at a position near a connection between the coolant supply path W2 and the coolant introduction port E01, see FIG. 6. The coolant supply path W20 connects to the coolant introduction pipe 11*a* having communication with a coolant inlet of the oil cooler 11. In addition, there is also disposed a coolant path W21, see FIG. 11, that connects to the coolant exhaust pipe 11*b* of the oil cooler 11. Though not shown in the figures, the coolant path W21 is communicated with the coolant path W4 providing communication between the coolant exit port E02 and the coolant inlet of the radiator 68.

The coolant pump Pw is rotatably driven by being operatively connected with the rotation of the crankshaft 1 as the internal combustion engine E is started. Coolant cooled by the radiator 68 is then drawn into the coolant pump Pw through the coolant intake port PwA1 thereof. Because of the boosted pump pressure in the coolant pump Pw, the coolant is delivered from the coolant discharge port PwB of the coolant pump Pw. The coolant is then supplied to the coolant supply path W3, see FIG. 11, including the water jacket 32 and the like of the engine E after having flowed through the coolant supply path W2 and by way of the coolant introduction port E01, see FIG. 6, for introducing coolant to the engine E at the center of the front portion E1 of the engine E.

The coolant supplied to the coolant supply path W3 of the engine E flows into the water jacket 32 surrounding the cylinder holes 31 forming a principal part of the coolant supply path W3. While flowing through the water jacket 32 and the coolant supply path not shown inside the cylinder head 40, the coolant absorbs heat. The heated coolant is then discharged from an outlet of the coolant supply path W3 of the engine E. More specifically, the heated coolant is discharged out of the engine E from the coolant exit port E02 for the coolant coming out of the engine E. The coolant thereafter flows through the coolant path W4 which is in communication with the coolant exit port E02 and is connected to the radiator 68, see FIG. 11. The coolant is then introduced into the radiator 68 through an inlet thereof at an upper portion thereof.

The heated coolant introduced into the radiator 68 circulates through the radiator 68. During circulation of the heated coolant through the radiator 68, heat is drawn off from the coolant and the coolant is cooled. The cooled coolant is again drawn into the coolant intake port PwA1 of the coolant pump Pw through the coolant return path W1 (see FIG. 6). Circulating through the aforementioned coolant supply path, the coolant is designed to cool different parts of the engine E.

The present invention as embodied in the preferred embodiment has the aforementioned structure. The present invention achieves the following effects that are unique to the preferred embodiment of the present invention.

More specifically, the lubricating oil supply paths F10, F11 for the exclusive use for the valve train 4 branch off a point near the outlet of the unit 10. The lubricating oil supply paths F10, F11 circumvent the oil gallery F5. The lubricating oil is therefore directly supplied to the camshafts 4*a*, 4*b* in the valve train 4. Accordingly, a pressure drop that would otherwise tend to occur during the supply of the lubricating oil to the valve train 4 can be completely eliminated. Positive and effective lubrication in the valve train 4 can therefore be achieved.

The check valve V2 for regulating the supply amount of the lubricating oil according to the operating condition of the engine E is disposed on the lubricating oil supply path F4 going to the oil gallery F5. When the engine is operated at a low speed, the check valve V2 is substantially throttled. This suppresses the supply amount of the lubricating oil to the oil gallery F5. While, a greater amount of lubricating oil corresponding to the suppressed amount of oil to the oil gallery F5 is supplied to the valve train 4. A sufficient amount of the lubricating oil is therefore supplied to the valve train 4 despite a condition, in which a lubricating oil supply pressure is low with the engine E operating at a low speed.

The lubricating oil supply paths F10, F11 for the exclusive use for camshafts 4*a*, 4*b* of the valve train 4 are simply in there structure. The paths F10, F11 basically include the supply path F10 extending in the horizontal direction and the supply path F11 having communication with the supply path F10 and extending substantially in the vertical direction. This simple structure ensures a smooth supply of the lubricating oil to the valve train and suppresses a drop in the lubricating oil supply pressure. The structure thereby secures a sufficient amount of the lubricating oil for lubrication of the valve train. Lubrication of the camshafts 4*a*, 4*b* and the valve train 4 including the camshafts 4*a*, 4*b* can be positively and effectively performed.

Further, the lubricating oil supply paths F10, F11 for the exclusive use for the valve train 4 extend along the opening portions 30A, 40A for the cam chain 4*e* and along the water jacket 32 of the cylinder block 30. The lubricating oil can maintain a sufficiently cooled state based on the advantageous cooling performance retention structure when supplied to the camshafts 4*a*, 4*b* of the valve train. Effective lubrication and cooling in the valve train 4 can therefore achieved.

The valve train lubricating structure in the internal combustion engine mounted on the snow vehicle according to the present invention is applicable to internal combustion engines for various types of vehicles and for other purposes.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A valve train lubricating structure in an internal combustion engine, comprising:

a supply feed pump and a return oil pump;

an oil pump shaft coaxially connected to an end of a crankshaft, the supply feed pump and the return oil pump being juxtaposed on the oil pump shaft;

a supply path for providing a route, through which a lubricating oil delivered from the oil pump is supplied to an oil gallery; and a plurality of branch supply paths for providing routes, through which the lubricating oil is supplied to different parts of the internal combustion engine, one of the plurality of branch supply paths forming a supply path of the lubricating oil to the valve train;

wherein the supply path of the lubricating oil to the oil gallery includes a check valve and the supply path going to the valve train is branched off at a point upstream of the check valve, wherein the supply feed pump is adapted to supply the lubricating oil, and the return oil pump is adapted to return oil accumulated in a crankcase to a sump oil tank.

2. The valve train lubricating structure in an internal combustion engine according claim 1, wherein the supply feed pump is operatively connected to the sump oil tank and further including an oil cooler and an oil filter operatively connected to said supply feed pump for supplying the lubricating oil from the sump oil tank to the oil cooler and the oil filter.

3. The valve train lubricating structure in an internal combustion engine according to claim 2, and further including a sump oil supply path for connecting the sump oil tank and the supply feed pump and a relief valve operatively positioned relative to said sump oil supply path and said supply feed pump for regulating lubricating oil supply pressure in the supply path.

4. The valve train lubricating structure in an internal combustion engine according to claim 1, wherein the check valve in the supply path for the lubricating oil supplied to the oil gallery is automatically controlled in response to a supply pressure of the lubricating oil.

5. The valve train lubricating structure in an internal combustion engine according to claim 4, wherein said check valve suppresses a supply of the lubricating oil when the engine is operated at a low speed for increasing the flow of the lubricating oil to the valve train.

6. The valve train lubricating structure in an internal combustion engine according to claim 4, wherein said check valve increases a supply of the lubricating oil when the engine is operated at a high speed for decreasing the flow of the lubricating oil to the valve train.

7. The valve train lubricating structure in an internal combustion engine according to claim 1, wherein the supply path of the lubricating oil to the valve train includes a plurality of apertures for supplying the lubricating oil to cam surfaces of the valve train.

8. The valve train lubricating structure in an internal combustion engine according to claim 1, wherein said supply path of the lubricating oil to the valve train includes a substantially horizontal section passing through the joint between the crankcase and the crankcase cover, and a substantially vertical section for supplying lubricating oil to the valve train.

9. The valve train lubricating structure in an internal combustion engine according to claim 8, wherein said substantially vertical section of the supply path of the lubricating oil to the valve train includes two branches for supplying oil to two camshafts.

10. The valve train lubricating structure for an internal combustion engine according to claim 1, wherein the check valve is disposed in a portion of the supply path that is located beneath a generator.

11. The valve train lubricating structure for an internal combustion engine according to claim 1, wherein the supply feed pump and the return oil pump are mounted on the oil pump shaft outwardly of a generator that is mounted on the end of the crankshaft.

12. The valve train lubricating structure for an internal combustion engine according to claim 1, wherein the return oil pump mounted in a position inwardly with respect to the supply feed pump.

13. A valve train lubricating structure for an internal combustion engine, comprising:

an oil pump and a generator mounted on one end of the crankshaft, and being rotated by the crankshaft;

a supply path for supplying lubricating oil delivered from the oil pump to an oil gallery; and a plurality of branch supply paths for supplying the lubricating oil to predetermined parts of the internal combustion engine, one of the plurality of branch supply paths forming a supply path of the lubricating oil to the valve train;

wherein the supply path of the lubricating oil to the oil gallery includes a check valve and the supply path for supplying lubricating oil to the valve train is branched off at a point upstream of the check valve, wherein the check valve is disposed in a portion of the supply path that is located beneath the generator.

14. The valve train lubricating structure for an internal combustion engine according to claim 13, wherein said oil pump includes a supply feed pump for supplying the lubricating oil and also includes a return oil pump operatively mounted relative to said crankshaft for returning oil accumulated in a crankcase to a sump oil tank.

15. The valve train lubricating structure for an internal combustion engine according to claim 14, wherein the supply feed pump is operatively connected to the sump oil tank and further including an oil cooler and oil filter operatively connected to said supply feed pump for supplying the lubricating oil from the sump oil tank to the oil cooler and oil filter.

16. The valve train lubricating structure for an internal combustion engine according to claim 15, and further including a sump oil supply path for connecting the sump oil tank and the supply feed pump and a relief valve operatively positioned relative to said sump oil supply path and said supply feed pump for regulating lubricating oil supply pressure in the supply path.

17. The valve train lubricating structure for an internal combustion engine according to claim 13, wherein the check valve in the supply path for the lubricating oil supplied to the oil gallery is automatically controlled in response to a supply pressure of the lubricating oil.

18. The valve train lubricating structure for an internal combustion engine according to claim 17, wherein said check valve suppresses a supply of the lubricating oil when the engine is operated at a low speed for increasing the flow of the lubricating oil to the valve train.

19. The valve train lubricating structure for an internal combustion engine according to claim 17, wherein said check valve increases a supply of the lubricating oil when the engine is operated at a high speed for decreasing the flow of the lubricating oil to the valve train.

20. The valve train lubricating structure for an internal combustion engine according to claim 13, wherein the supply path of the lubricating oil to the valve train includes a plurality of apertures for supplying the lubricating oil to cam surfaces of the valve train.

21. The valve train lubricating structure for an internal combustion engine according to claim 13, wherein said supply path of the lubricating oil to the valve train includes a substantially horizontal section passing through the joint between the crankcase and the crankcase cover, a substantially vertical section for supplying lubricating oil to the valve train.

22. The valve train lubricating structure for an internal combustion engine according to claim 21, wherein said substantially vertical section of the supply path of the lubricating oil to the valve train includes two branches for supplying oil to two camshafts.

* * * * *